US008397733B2

(12) United States Patent
Robertson

(10) Patent No.: US 8,397,733 B2
(45) Date of Patent: Mar. 19, 2013

(54) DEGRADABLE CIGARETTE FILTER: PILL WITH MULTILAYERED COATING

(75) Inventor: Raymond M. Robertson, Blacksburg, VA (US)

(73) Assignee: Celanese Acetate LLC, Dallas, TX (US)

( * ) Notice: Subject to any disclaimer, the term of this patent is extended or adjusted under 35 U.S.C. 154(b) by 420 days.

(21) Appl. No.: 12/687,912

(22) Filed: Jan. 15, 2010

(65) Prior Publication Data

US 2011/0174324 A1 Jul. 21, 2011

(51) Int. Cl.
*A24B 15/18* (2006.01)

(52) U.S. Cl. ..... 131/334; 131/332; 131/345

(58) Field of Classification Search ..... 131/332, 131/345, 334
See application file for complete search history.

(56) References Cited

U.S. PATENT DOCUMENTS

| | | | | |
|---|---|---|---|---|
| 2,105,252 | A | | 1/1938 | Malm |
| 5,417,682 | A | * | 5/1995 | Wong et al. ..... 604/892.1 |
| 5,495,860 | A | | 3/1996 | Teufel et al. |
| 5,706,833 | A | | 1/1998 | Tsugaya et al. |
| 5,970,988 | A | | 10/1999 | Buchanan et al. |
| 6,739,344 | B2 | | 5/2004 | Yamashita |
| 2008/0127988 | A1 | | 6/2008 | Grubbs et al. |
| 2008/0274149 | A1 | | 11/2008 | Seiler et al. |
| 2009/0151738 | A1 | | 6/2009 | Robertson et al. |

FOREIGN PATENT DOCUMENTS

WO WO 2011/077141 A1 6/2011

OTHER PUBLICATIONS

J. Gu, "Cellulose Acetate Biodegradability Upon Exposure to Simulated Aerobic Composting and Anaerobic Bioreactor Environments," Journal of Polymers and the Environment, (vol. 1), (Issue. 2), (p. 143-153), (1993).

* cited by examiner

*Primary Examiner* — Richard Crispino
*Assistant Examiner* — Dionne Walls Mayes
(74) *Attorney, Agent, or Firm* — Hammer & Associates, P.C.

(57) ABSTRACT

A degradable cigarette filter includes a filter element of a bloomed cellulose acetate tow and a plug wrap surrounding the filter element, and a pill dispersed in the tow. The pill includes a material adapted to catalyze hydrolysis of the cellulose acetate tow that is encapsulated with an inner layer of a water soluble or water permeable material and an outer layer of a cellulose acetate having a D.S. in the range of 2.0-2.6.

14 Claims, 1 Drawing Sheet

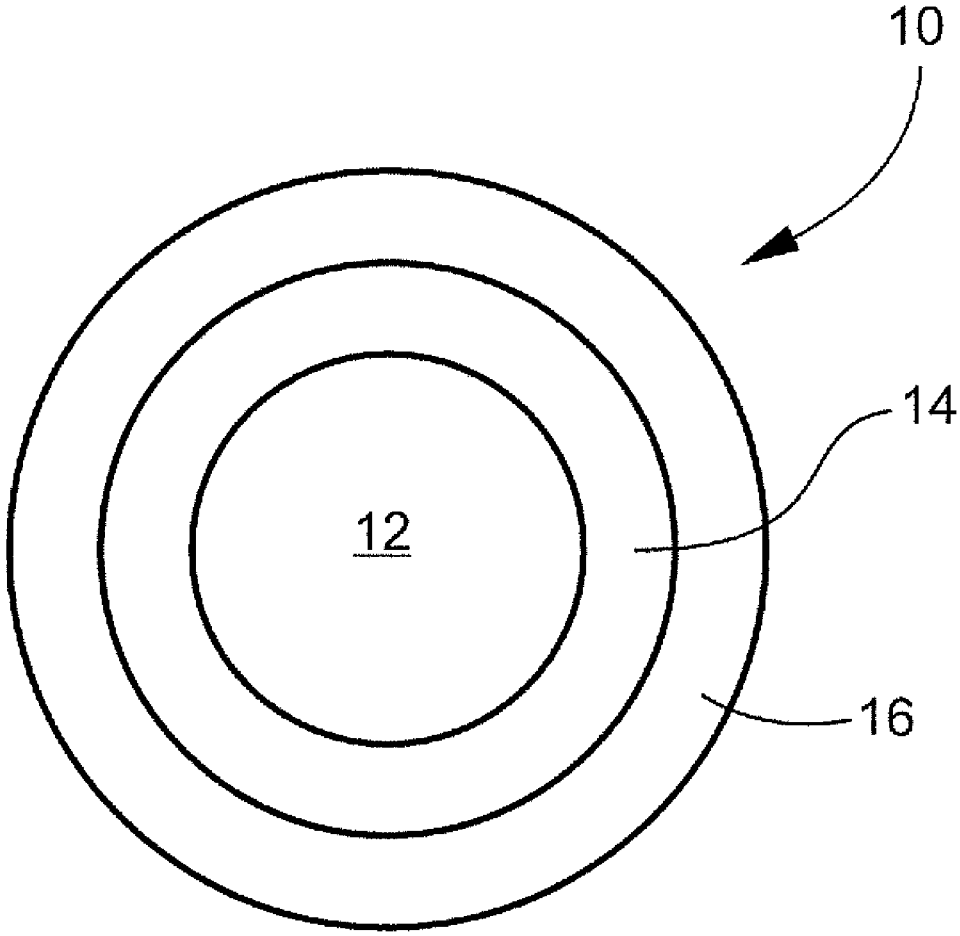
10
14
12
16

DEGRADABLE CIGARETTE FILTER: PILL WITH MULTILAYERED COATING

FIELD OF THE INVENTION

This invention is directed to a degradable cigarette filter.

BACKGROUND OF THE INVENTION

US Patent Publication No. 2009/0151738, incorporated herein by reference, discloses a degradable cigarette filter where the degradation is obtained by materials that catalyze the hydrolysis of the cellulose acetate filament. Cellulose acetate used in the filaments of cigarette filters typically has a Degree of Substitution (D.S.) in the range of 2.0-2.6. Cellulose acetate with a D.S. in the range of 2.0-2.6 is not readily attacked by naturally occurring enzymes and bacteria; however, cellulose acetate with a D.S. of ≦1.0 is vunerable to attack by naturally occurring enzymes and bacteria. To reduce the D.S. of the cellulose acetate, the cellulose acetate must be hydrolyzed (i.e., replacement of the acetate moieties with hydroxyl moieties).

In US Patent Publication No. 2009/0151738, one method for carrying out the invention was the use of a pill (or pills) dispersed into the tow. These pills comprised the hydrolysis catalyst being coated with the water soluble material. These pills worked as expected and the cellulose acetate tow was hydrolyzed and then degraded. However, this simple construction was defficient in two ways; first, the catalyst was too quickly released, and second, the pill was a foreign object that could negatively impact the taste of the smoke. The release of catalyst too quickly can lead to the complete loss of catalyst before hydrolysis (or sufficient hydroysis) can occur, whereby the purpose of the invention is defeated.

Accordingly, there is a need for a new pill construction that provides for the controlled and sustained release of the hydrolysis catalysis and that will not negatively impact the taste of the cigarette smoke.

SUMMARY OF THE INVENTION

A degradable cigarette filter includes a filter element of a bloomed cellulose acetate tow and a plug wrap surrounding the filter element, and a pill dispersed in the tow. The pill includes a material adapted to catalyze hydrolysis of the cellulose acetate tow that is encapsulated with an inner layer of a water soluble or water permeable material and an outer layer of a cellulose acetate having a D.S. in the range of 2.0-2.6.

DESCRIPTION OF THE DRAWINGS

For the purpose of illustrating the invention, there is shown in the drawings a form that is presently preferred; it being understood, however, that this invention is not limited to the precise arrangements and instrumentalities shown.

FIG. 1 is a cross sectional view of the pill made according to the present invention.

DETAILED DESCRIPTION OF THE INVENTION

A degradable cigarette filter generally includes a filter element (or filter plug) made of a bloomed cellulose acetate tow, a plug wrap surrounding the filter element, and a pill dispersed in the tow. The pill contains a material for catalyzing the hydrolysis of the cellulose acetate tow. The pill may be added to the filter element during cigarette filter manufacture.

The pill may be a single pill or a plurality of pills. The foregoing shall be explained in greater detail below.

A degradable cigarette filter, as used herein, refers to a cigarette filter that will decompose when exposed to an outdoor environment (i.e., exposed to rain, dew, or other sources of water). The degree of degradation is, at a minimum, sufficient to convert the cellulose acetate (in cigarette filters, cellulose acetate generally has a D.S. of 2.0-2.6) into cellulose acetate (D.S. ≦1.0), and, at a maximum, sufficient to convert the cellulose acetate into glucose. The time period for such degradation is less than the time for an equivalent amount of untreated cellulose acetate to decompose and typically may be several months (e.g., 2-6 months) or less.

The pill 10, see FIG. 1, contains a material adapted to catalyze hydrolysis of the cellulose acetate tow 12 that is encapsulated with an inner layer 14 of a water soluble or water permeable material and an outer layer 16 of a cellulose acetate having a D.S. in the range of 2.0-2.6. Each of these components will be discussed in greater detail below.

The material adapted to catalyze hydrolysis of the cellulose acetate tow 12 is any material that can catalyze hydrolysis of the cellulose acetate tow. Catalyze hydrolysis, as used herein, refers to the removal of an acetate moiety from the cellulose backbone. Ideally, all acetate moieties are removed, but such ideal conditions are not necessary for degradation, and a cellulose acetate with a D.S. of ≦1.0 is sufficient for degradation (e.g., attack by naturally occurring enzymes and bacteria). For hydrolysis of the cellulose acetate to occur, only the cellulose acetate, the material to catalyze hydrolysis, and water are typically necessary.

The material adapted to catalyze hydrolysis 12 may be divided into several categories of materials: acids, acid salts, bases, and bacterium adapted to generate an acid. The acids should have a $pK_a$ of <6. The bases should have a $pK_b$ of <6. Materials from these categories are typically used alone, but combinations are possible.

The acids include: acetic, ascorbic, ascorbyl-2-phosphate, ascorbyl-2-sulfate, aspartic (aminosuccinic), cinnamic, citric, folic, glutaric, lactic, malic (1-hydroxysuccinic), nicotinic (nician), oxalic, succinic, tartaric, boric, hydrochloric, nitric, phosphoric, sulfuric, and combinations thereof. In most embodiments, either ascorbic, citric, lactic, or nicotinic acids are used.

Additionally, the acids may include a combination of a weak organic acid and a compound that can be hydrolyzed to a strong acid. In this combination, the weak organic acid hydrolyzes the compound, renders the strong acid, and the strong acid hydrolyzes the tow (typically to a sugar, e.g., glucose). Weak organic acids include: ascorbic acid, citric acid, lactic acid, nicotinic acid, hydroxysuccinic acid (apple acid), and combinations thereof. Compounds that can be hydrolyzed to a strong acid include: cellulose sulfate, dodecyl sulfate, ascobryl-2-sulfate, ascorbyl-2-phosphate, phosphorus pentoxide, phosphorus pentoxide based esters, cellulose nitrate, 2-ethyl hexyl phosphate, and combinations thereof.

The acid salts include: metal salts where said metal is selected from the group consisting of: aluminum, potassium, sodium, or zinc, and the non-metal portion of the salt is selected from the group consisting of nitrates, dihydrogen phosphates, hydrogen phosphates, phosphates hydrogen sulfates, sulfates, and combinations thereof. Also included as an acid salt are: alum (aluminum potassium sulfate) and aluminum ammonium sulfate. In most embodiments, either sodium hydrogen sulfate ($NaHSO_4$) or sodium dihydrogen phosphate ($NaH_2PO_4$) is used.

The bases include: metal hydroxides, calcium oxide (lime), urea, borax, sodium metasilicate, ammonium hydroxide, sodium carbonate, sodium phosphate tribasic, sodium hypochlorite, sodium hydrogen carbonate (sodium bicarbonate), and combinations thereof.

The bacterium may be either a bacterium that produces an acid or a bacterium that attacks and degrades the cellulose acetate directly. Bacterium that produces an acid typically must be provided with a food source. So, when this bacterium is released, by dissolving action of water, the bacterium digests the food source, produces a weak acid, and the weak acid catalyzes the hydrolysis of the cellulose acetate. The bacterium that produces an acid includes: *lactobacillus acidophilus, bifidobacterium longum, acetobacterium woodii, acetobacter aceti* (vinegar bacteria), and combinations thereof. The food sources for these bacteria are conventional and may include lactose, glucose, and/or triactin based materials. Bacterium that attacks and degrades cellulose acetate directly does not require the food source. The bacterium that attacks and degrades the cellulose acetate directly includes: *rhizobium meliloti, alcaligenes xylosoxidans*, and combinations thereof.

The amount of the material adapted to catalyze hydrolysis present in the filter element must be sufficient to cause degradation of the cellulose acetate tow at a rate faster than an equivalent untreated filter element. For example, in one embodiment of the invention, the time for degradation may be 2-6 months. The amount of the material will depend upon, for example: the weight of the cellulose acetate in the filter element, the desired time for degradation of the filter element, and the material adapted to catalyze hydrolysis chosen (to name a few).

For example, if an acid is chosen and the target time for degradation is 2-6 months, then, in one embodiment, the amount of acid may be in the range of 2-200% by weight of the cellulose acetate in the filter element. In another embodiment, using the same desired outcomes as above, the amount of acid may be in the range of 5-100% by weight of the cellulose acetate. In yet another embodiment, the amount of acid may be in the range of 10-50% by weight of the cellulose acetate.

If a base is chosen and the target time for degradation is 2-6 months, then the amount of base may be in the range of 50-500% by weight of the cellulose acetate in the filter element. In another embodiment, using the same desired outcomes as above, the amount of base may be in the range of 80-300% by weight of the cellulose acetate. In yet another embodiment, the amount of base may be in the range of 100-200% by weight of the cellulose acetate.

If a bacterium is chosen and the target time for degradation is 2-6 months, then the amount of bacterium is 1 to billion colony forming units plus the needed food.

The layers 14 and 16 that surround and encapsulate the material adapted to catalyze hydrolysis of the cellulose acetate tow 12 will encapsulate the material 12 so that 1) excess water does not merely wash away this material and there is sufficient material over time to catalzye the hydrolysis, 2) to prevent the smoke from taking on the favor of materials other than cellulose acetate that may adversely impact the taste attributes of the smoke, and 3) to facilitate bonding of the pill to the filaments of the tow by conventional tow binding materials, such as, for example, triacetin or glyceryl triacetate. The inner and outer layers may act together to control the release of the material 12 and the outer layer 16 acts to mask the taste of material 12 and layer 14 and facilitate bonding.

The inner layer 14 is a water soluble material or a water permeable material. These materials may be any material that can encapsulate (i.e., contain the material adapted to catalyze hydrolysis); but, when in contact with water, will either dissolve and thereby allow catalysis of the hydrolysis or allow water to pass and thereafter allow catasyt to escape. With the water soluble material, water will gel that material and the gelled material can then control the movement of water into the core or catayst out of the core. Further, the gelled material may swell which then can rupture the outer layer. Encapsulation is important for, at least two reasons: first, encapsulation prevents premature hydrolysis, and second, maintains shelf-life of the product (filter). The water soluble matrix material may be cellulose acetate (D.S.=0.8±0.2), carboxymethyl cellulose (CMC), hydroxyethyl cellulose, hydroxypropyl cellulose (HPC), hydroxypropyl methyl cellulose (HPMC), methyl cellulose, polyethylene glycol (PEG), polyvinyl acetate, polyvinyl alcohol, starch, sugar, and combinations thereof. The sugars may be glucose, sucrose, lactose, and combinations thereof. In most embodiments, the water soluble matrix material may be methyl cellulose, carboxymethyl cellulose, hydroxypropyl cellulose, hydroxypropyl methyl cellulose, polyvinyl alcohol, polyethylene glycol, and combinations thereof. The water permeable materials may include ethyl cellulose, shellac, zein (a prolamine protein found in corn), cellulsoe acetate (D.S.=2.0-2.6), cellulose phthalate, porous silicone elastomers (i.e., silicone elastomers with added PEG, where the PEG dissolves out to form pores), acrylic esters (e.g., commercially available unde the tradename EUDRAGIT from Evonik Degussa Corp., Piscataway, N.J.), and combinations thereof.

The outer layer 16 is cellulose acetate with a D.S. of 2.0-2.6. Cellulose acetate with a D.S. of 2.0-2.6 is water permeable. This cellulose acetate is preferably has the same or about the same (e.g., 'about the same' being where the D.S. being within ±25% of the filament tow) as the filament tow.

The amount of the inner layer 14 and the outer layer 16 should be sufficient to completely encapsulate the material adapted to catalyze hydrolysis of the cellulose acetate 12. Completely encapsulate refers to covering and isolating the material 12, so that it can not catalyze hydrolysis until water has permeated the outer layer 16 and dissolved away at least a part of the water soluble material (or permeate the water permeable material) of the inner layer 14. For example, the inner layer 14 may range from 5-100% by weight of the material 12, or 5-30% by weight in another embodiment. The outer layer 16 may range from 5-100% by weight or 5-30% by weight in another embodiment. Alternatively, the amount of the inner layer 14 and the outer layer 16 may be analogized with a rate of decay, i.e., 'half-life.' Half-life is the time required for the catalyst material to reduce the pH of the solution by ½ of the initial pH. In the data presented below 1 mL of water is appoximately equivalent to the volume of a standard cigarette filter. In the present invention, the half-life of the material should be at least 25 minutes, or in the range of 25-1000 minutes, or 50-500 minutes, or 75-300 minutes.

The present invention will be further illustrated in the following examples.

EXAMPLES

The cataylst consisted of citric acid and cellulose sulfate-Na salt with a 1:1 weight ratio. The catalyst was formed into pills (tablets) with an appoximate weight of 29.4 milligrams. These pills were then coated as indicated in Table 1 (coating weights are given in % weight of the uncoated pill).

To determine 'half-life,' 50 uncoated pills are placed into a 100 mL beaker containing 50 mL of water having a pH of 7. The beaker was stirred with a 1 cm star head stirrer at 100 rpm (to ensure uniformity of the pH). The pH of the solution was monitored (e.g., at one minute intervals) until the solution pH reached 3 or less. The same procedure was then repeated with the coated pills. Then, the first plot (uncoated pills, pH v. time) was compared with the subsequent plot (coated pill, pH v. time). The 'half-life' was determined by the difference in time at pH 4.95 (the appoximate mid point between the initial pH (7) and the final pH (3)).

TABLE 1

Half-life at various coating levels

| | 5% ethyl cellulose Inner coating | 10% ethyl cellulose Inner coating |
|---|---|---|
| 0% Cellulose Acetate Outer coating | 2.5 minutes | 58.5 minutes |
| 5% Cellulose Acetate Outer coating | 7.5 minutes | 62.5 minutes |
| 10% Cellulose Acetate Outer coating | 19.5 minutes | 98.5 minutes |
| 20% Cellulose Acetate Outer coating | 41.5 minutes | 135.5 minutes |

The present invention may be embodied in other forms without departing from the spirit and the essential attributes thereof, and, accordingly, reference should be made to the appended claims, rather than to the foregoing specification, as indicated the scope of the invention.

I claim:

1. A degradable cigarette filter, where said cigarette filter includes a filter element of a bloomed cellulose acetate tow and a plug wrap surrounding said filter element, further comprising:

a pill dispersed in said tow and comprising a material adapted to catalyze hydrolysis of said cellulose acetate tow being encapsulated with an inner layer of a water soluble or water permeable material and an outer layer of a cellulose acetate having a D.S. in the range of 2.0-2.6.

2. The degradable cigarette filter accordingly to claim 1 wherein said inner layer comprising from 5-100% by weight of said material adapted to catalyze hydrolysis of said cellulose acetate tow.

3. The degradable cigarette filter accordingly to claim 2 wherein said inner layer comprising from 5-30% by weight of said material adapted to catalyze hydrolysis of said cellulose acetate tow.

4. The degradable cigarette filter accordingly to claim 1 wherein said outer layer comprising from 5-100% by weight of said material adapted to catalyze hydrolysis of said cellulose acetate tow.

5. The degradable cigarette filter accordingly to claim 4 wherein said outer layer comprising from 5-30%; by weight of said material adapted to catalyze hydrolysis of said cellulose acetate tow.

6. The degradable cigarette filter according to claim 1 wherein said pill having a half-life of at least 25 minutes.

7. The degradable cigarette filter according to claim 6 wherein said half-life being in the range of 25-1000 minutes.

8. The degradable cigarette filter according to claim 6 wherein said half-life being in the range of 50-500 minutes.

9. The degradable cigarette filter according to claim 6 wherein said half-life being in the range of 75-300 minutes.

10. The degradable cigarette filter according to claim 1 wherein said material adapted to catalyze hydrolysis of said cellulose acetate tow being selected from the group consisting of: an acid, an acid salt, a base, or a bacterium adapted to generate an acid, or combinations thereof.

11. The degradable cigarette filter according to claim 1 wherein said water soluble material being selected from the group consisting of: cellulose acetate (D.S.=0.8±0.2), carboxymethyl cellulose, hydroxyethyl cellulose, hydroxypropyl cellulose, hydroxypropyl methyl cellulose, methyl cellulose, polyethylene glycol, polyvinyl acetate, polyvinyl alcohol, starch, sugar, and combinations thereof.

12. The degradable cigarette filter according to claim 11 wherein said sugar being selected from the group consisting of: glucose, sucrose, lactose, and combinations thereof.

13. The degradable cigarette filter according to claim 1 wherein said water permeable material being selected from the group consisting of: ethyl cellulose, zein, cellulose acetate (D.S.=2.0-2.6), cellulose acetate phthalate, porous silicone elastomers, arcylic esters, and combinations thereof.

14. A cigarette having a filter according to claim 1.

* * * * *